US006816601B2

(12) United States Patent
Lin et al.

(10) Patent No.: US 6,816,601 B2
(45) Date of Patent: Nov. 9, 2004

(54) MICROPHONE AND BATTERY CONFIGURATION FOR HEARING INSTRUMENTS

(75) Inventors: Shin Chai Mark Lin, Millburn, NJ (US); Oleg Saltykov, Fairlawn, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 0 days.

(21) Appl. No.: 10/092,659

(22) Filed: Mar. 7, 2002

(65) Prior Publication Data

US 2003/0169893 A1 Sep. 11, 2003

(51) Int. Cl.[7] ..... H04R 25/00
(52) U.S. Cl. ..... 381/322; 381/381; 381/324
(58) Field of Search ..... 381/322, 323, 381/328, FOR 135, FOR 138, 23.1, 312, 324, 72, 374, FOR 127, FOR 137

(56) References Cited

U.S. PATENT DOCUMENTS 5,357,576 A * 10/1994 Arndt ..... 381/328
6,254,426 B1 7/2001 Juneau et al.
6,493,454 B1 * 12/2002 Loi et al. ..... 381/328

FOREIGN PATENT DOCUMENTS

WO WO 99/27755 6/1999
WO WO 01/54457 A1 7/2001

OTHER PUBLICATIONS

International Search Report.

International search report.

* cited by examiner

*Primary Examiner*—Curtis Kuntz
*Assistant Examiner*—Brian Ensey
(74) *Attorney, Agent, or Firm*—Mark H. Jay

(57) ABSTRACT

The dimensions of a hearing instrument can be minimized by positioning the internal components in a configuration that occupies the least amount of volume. A pocket for situating the microphone on a diagonal aids in decreasing the required size of the instrument's shell and facilitates assembly.

7 Claims, 6 Drawing Sheets

MICROPHONE AND BATTERY CONFIGURATION FOR HEARING INSTRUMENTS

BACKGROUND OF THE INVENTION

The shell of a hearing instrument that resides in the ear must provide the internal volume necessary to house its various components while at the same time remain sufficiently small to fit in the user's ear canal. Examples of these instruments are shown in U.S. Pat. Nos. 5,799,095; 5,889,874; 5,915,031; and 6,088,465, all incorporated by reference herein. Some of these components include a battery, a microphone, a receiver, the electronics, and packaging.

DESCRIPTION OF THE INVENTION

By positioning the microphone in a pocket that orients it at an angle with respect to the plane of the instrument's faceplate, close to the battery, the use of internal volume in the shell can be maximized while the overall size of the shell can be minimized.

Figure 1:
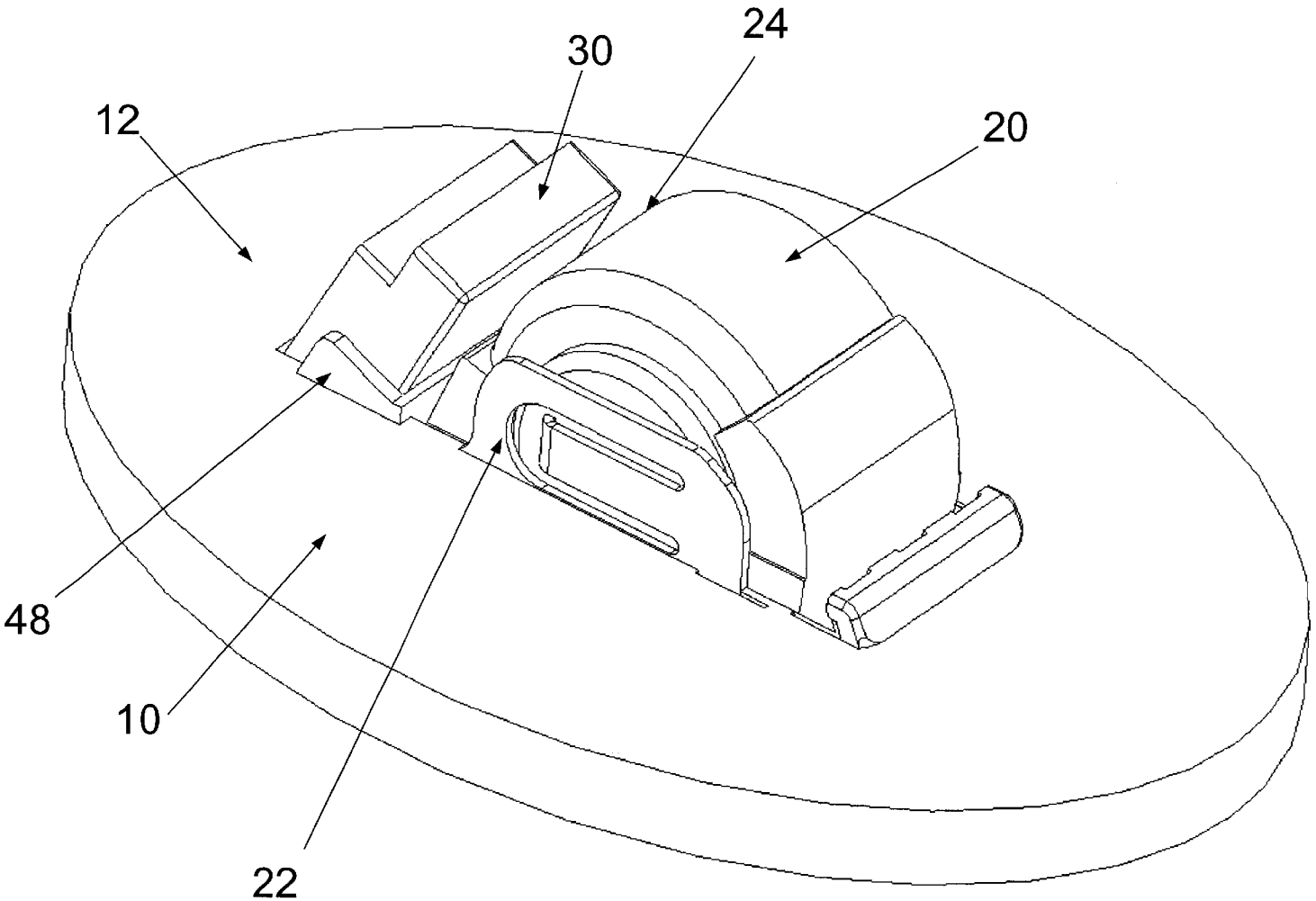
FIG. 1 is a drawing of a hearing instrument faceplate having a battery and a microphone.

A faceplate 10, illustrated in FIG. 1, provides a foundation for certain components of the hearing instrument, including a generally cylindrically_shaped battery 20 and a microphone 30. As shown in U.S. Pat. Nos. 5,799,095 and 6,088,465, the battery 20 resides in a door built into the faceplate. (See element 32 in both patents.)

Figure 2:
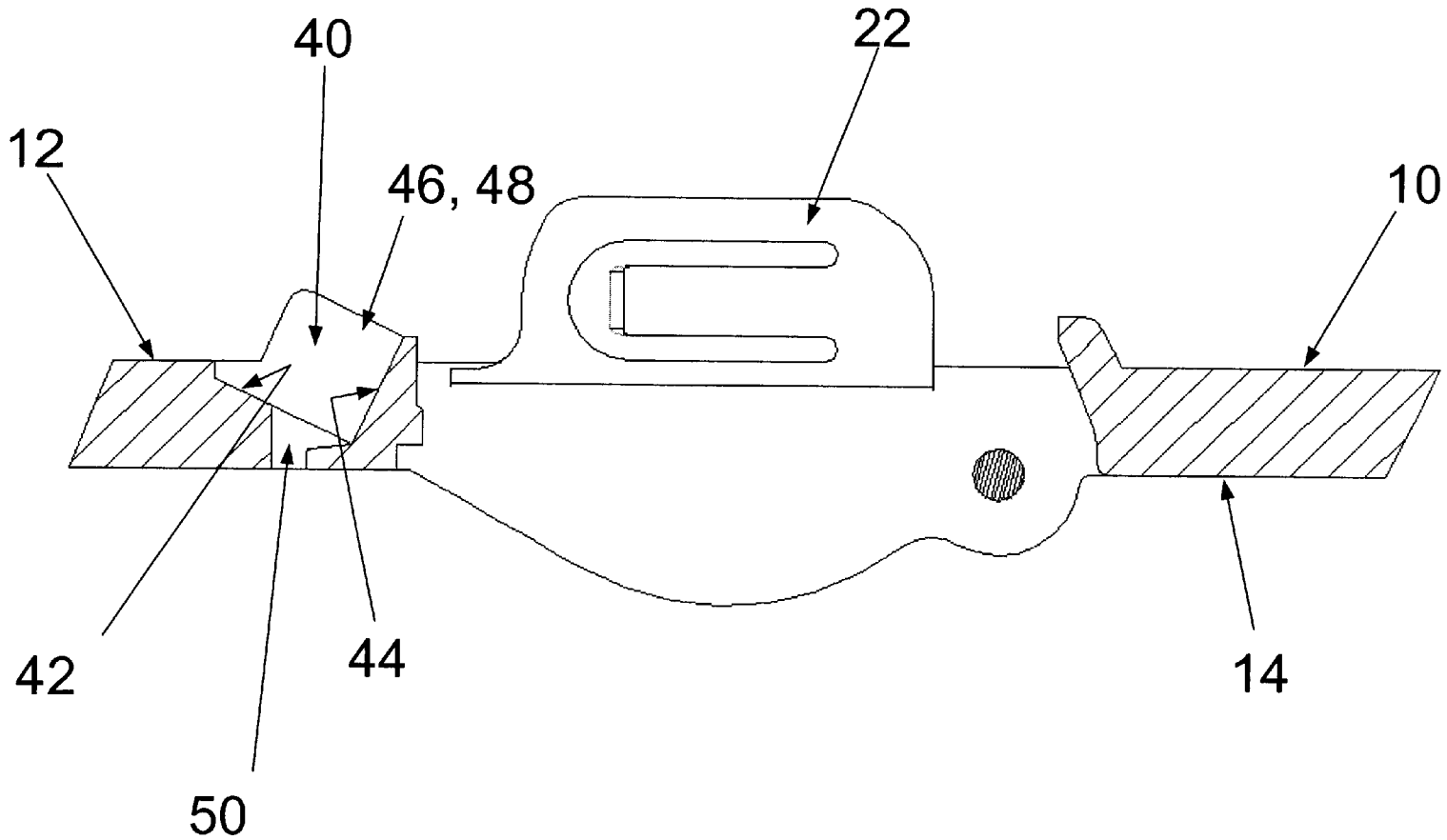
FIG. 2 is a partial elevation view of the faceplate of FIG. 1.

The faceplate 10 is shown without the battery 20 and a microphone 30 in the partial elevation view of FIG. 2. A support contact bracket 22 holds the battery 20 (see FIG. 1), although only one is visible in FIG. 2.

Figure 3:
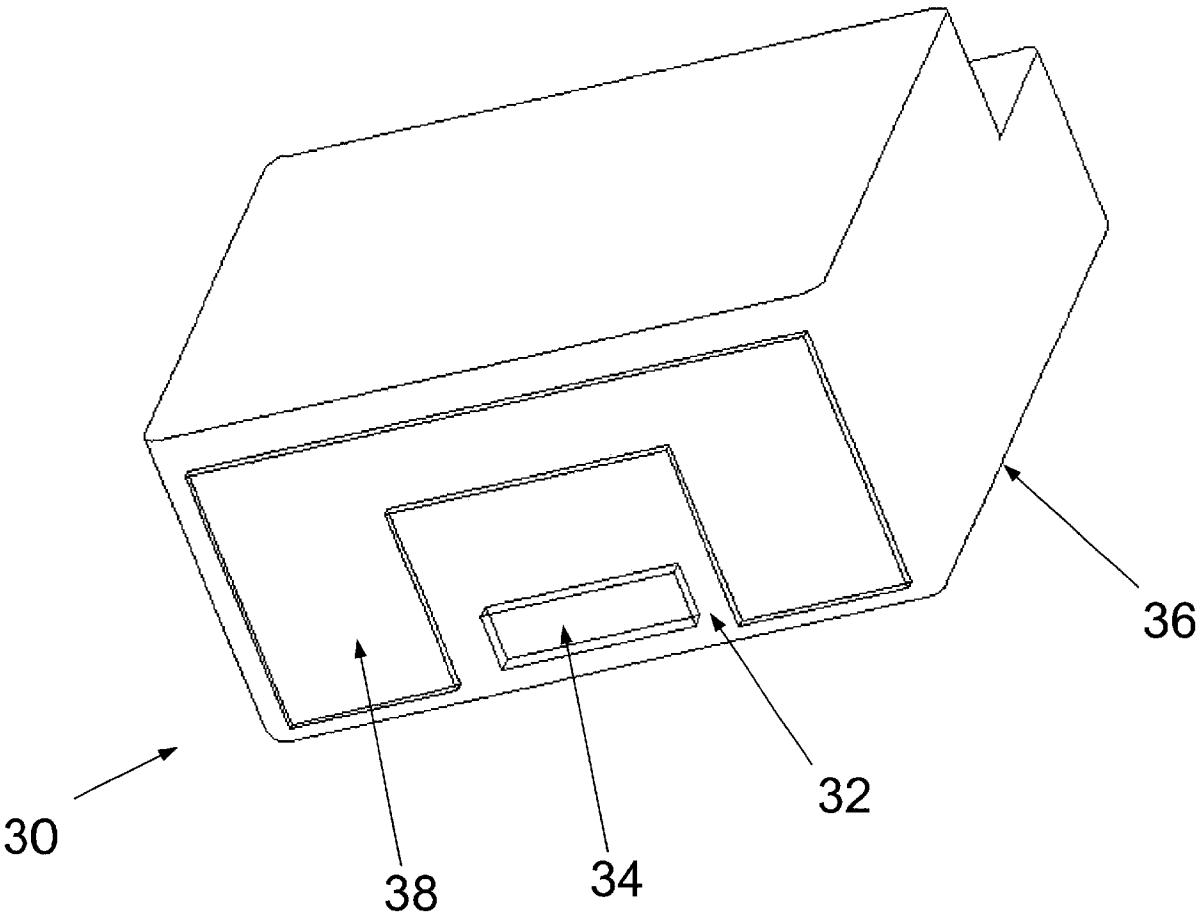
FIG. 3 is a perspective view of a hearing instrument microphone.
Figure 4:
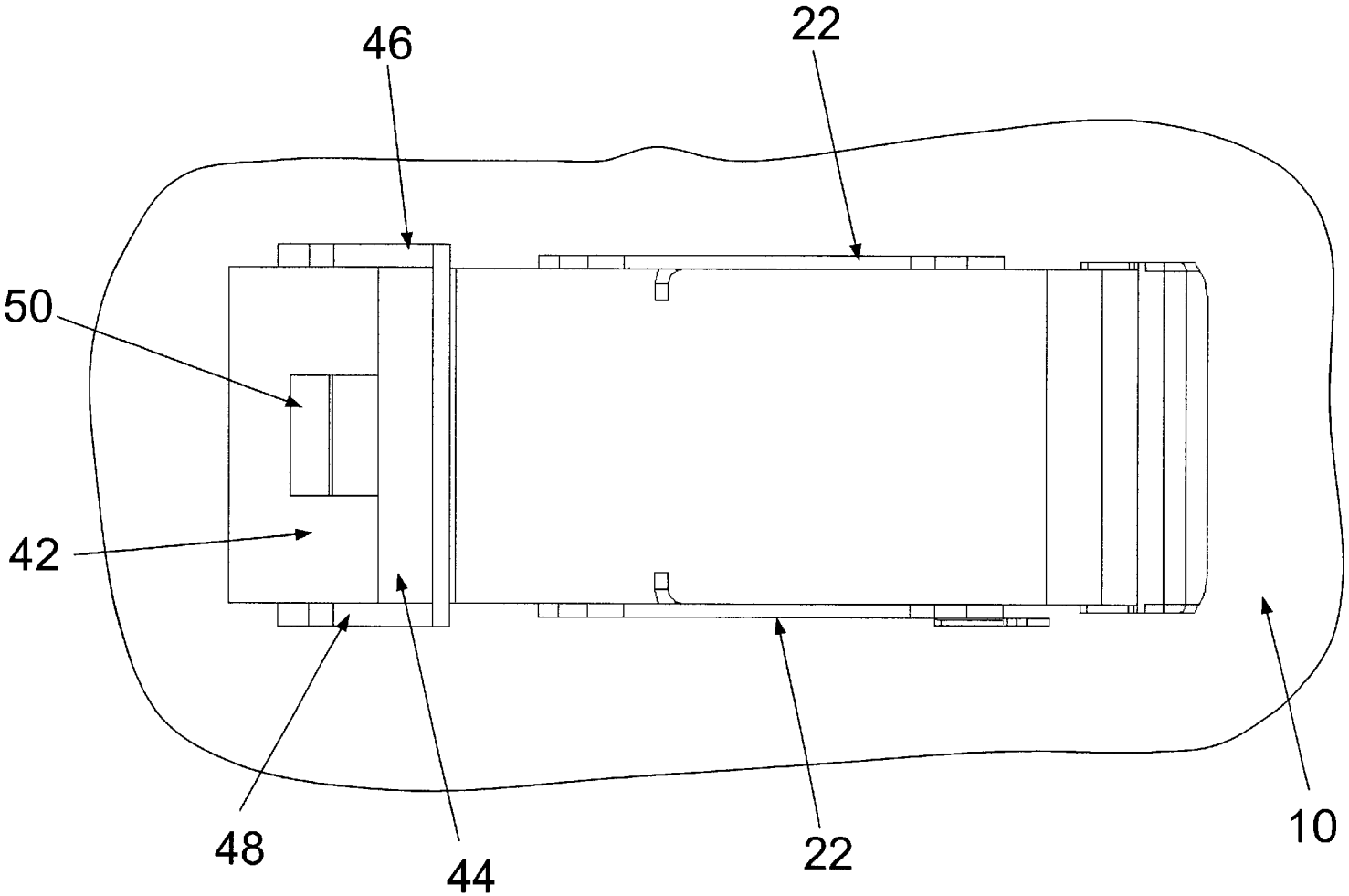
FIG. 4 is a view of the inside surface of the faceplate of FIG. 1 with the battery and microphone removed.

The microphone 30 is shown separately in FIG. 3. A bottom face or surface 32 of the microphone 30 has an opening 34 that admits sound to the inside of the microphone body (not visible nor shown).

A pocket 40 for the microphone 30 is provided on the inside surface 12 of the faceplate 10 to one side of the battery 20. The pocket 40 has two generally rectangular surfaces adjoining one another at right angles: a rectangular face 42 that functions as a seat for the bottom face 32 of the microphone 30 and a back section 44 that receives a portion of the back surface 36 of the microphone 30. Together, the rectangular face 42 and the back section 44 define opposing triangular surfaces 46 and 48 that complete the pocket.

The opposing surfaces 46 and 48 can be extended above the inside surface 12 of the faceplate 10 to provide additional support for the microphone 30, as shown in FIGS. 1 and 2. Collectively, the four faces 42, 44, 46, and 48 provide a generally conforming fit and a secure registration for the microphone 30.

The rectangular face 42 is oriented at some angle between zero and ninety degrees with respect to the outside surface 14 of the faceplate 10. As can be seen from FIGS. 1 and 2, that angle can be selected so that there will be clearance between the microphone 30 and the battery 20, while bringing the two components close together. In FIG. 2, the angle is approximately 25°. As a result, the back surface 36 of the microphone 30 is tangential to the curved surface 24 of the battery 20, save for the required clearance.

The sound from the outside of the hearing instrument must have a path to the microphone 30. In FIG. 2, a channel 50 connects the pocket 40 with the outside surface 14 of the faceplate 10, providing an acoustical path for the opening 34 in the bottom face 32 of the microphone 30 to the outer surface 14 of the faceplate 10. The channel 50 should be sufficiently large to allow the sound to travel without attenuation or distortion.

To aid in positioning and retention of the microphone 30 in the pocket 40, an adhesive 38 can be applied to a portion of the bottom face 32 of the microphone 30. When the microphone 30 is inserted into the pocket 40, the adhesive 38 will provide a bond between the bottom surface 32 and the rectangular face 42 of the pocket 40. It also provides an acoustic seal.

Figure 5:
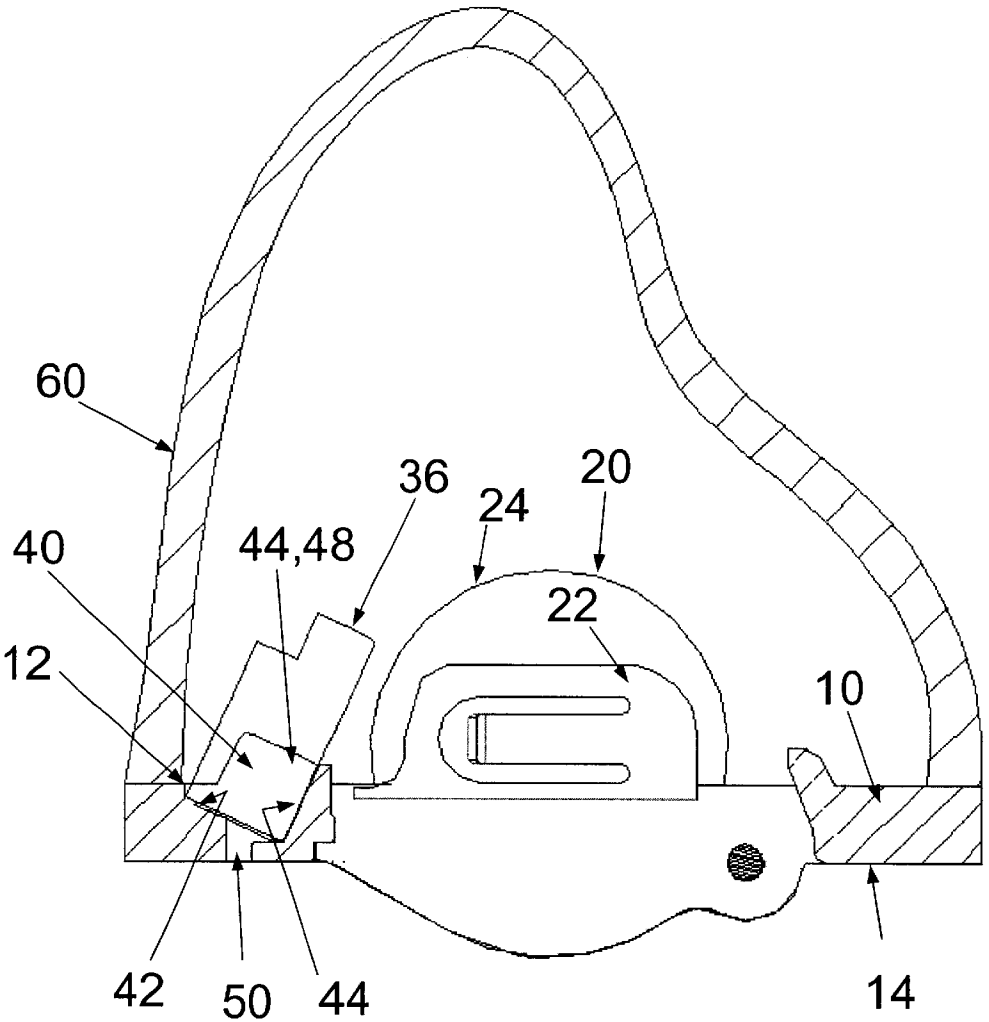
FIG. 5 is a partial cut-away elevation view of a hearing instrument.
Figure 7:
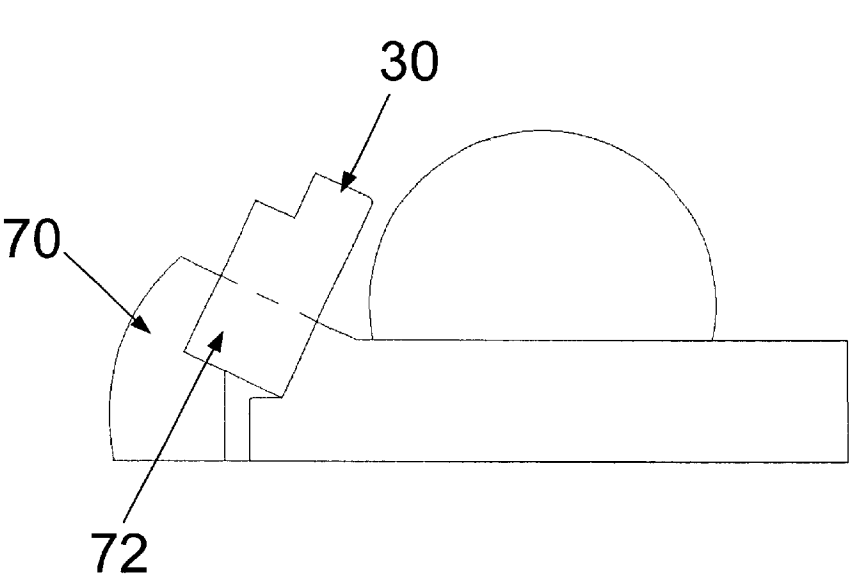
FIG. 7 illustrates an alternative faceplate.
Figure 6:
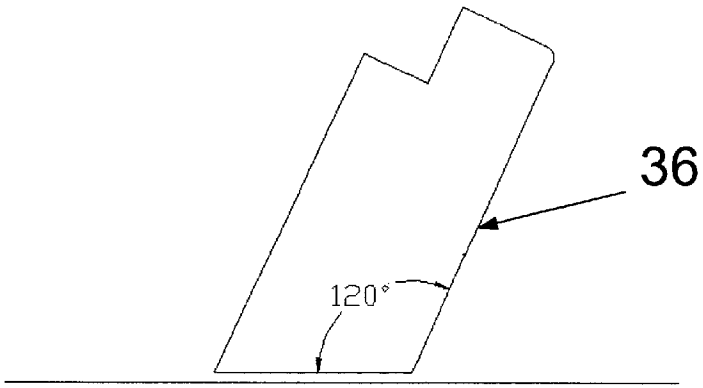
FIG. 6 illustrates an alternative microphone for a hearing instrument.

The faceplate 10 is shown with a shell 60 in FIG. 5. The position of the microphone 30 closely adjacent the battery 20 allows for a narrower profile (in the vertical direction on the page) for the shell 60.

Instead of the pocket 40, other arrangements could be used to situate the microphone 30 at an angle. For example, the bottom face 32 of the microphone 30 could be fabricated with an angle of 120° with respect to the back surface 36. Alternatively, the inside surface 12 of the faceplate 10 could be fabricated with a ramp 70 comprising a pocket 72 that accepts the microphone 30.

What is claimed is:

1. A faceplate assembly for a hearing instrument, comprising:

a battery receptacle for a battery; and a pocket for a microphone, where the pocket comprises a recess in one side of the faceplate and further comprises a surface that mates with a surface of the microphone; and the faceplate defines a plane and the surface of the pocket is oriented at a non-right angle with respect to the plane of the faceplate.

2. An assembly as set forth in claim 1, further comprising an adhesive applied to the surface of the pocket.

3. A hearing instrument, comprising:

a shell housing; and a faceplate that attaches to the shell, where the shell comprises a battery receptacle located on the faceplate; and a pocket for a microphone integral with the faceplate, where the pocket comprises a recess in one side of the faceplate and further comprises a surface that mates with a surface of the microphone; and the faceplate defines a plane and the surface of the pocket is oriented at a non-right angle with respect to the plane of the faceplate.

4. An instrument as set forth in claim 3, further comprising an adhesive applied to the surface of the pocket.

5. A modular assembly for a hearing instrument, comprising:

a faceplate comprising generally parallel inside and outside surfaces;

a generally cylindrically-shaped battery located in a receptacle on the faceplate, where the battery partially protrudes above the inside surface; and a microphone, where a surface of the microphone is nearly tangential to the cylindrical surface of the battery, where the faceplate defines a plane and the surface of the microphone tangential to the battery surface is oriented at a non-right angle with respect to the plane of the faceplate.

6. An assembly as set forth in claim 1, further comprising:

a generally cylindrically-shaped battery located in the battery receptacle, where the battery partially protrudes above the inside surface; and a microphone, where a surface of the microphone is nearly tangential to the cylindrical surface of the battery and the surface of the microphone tangential to the battery surface is oriented at a non-right angle with respect to the plane of the faceplate.

7. An instrument as set forth in claim 3, further comprising:

a generally cylindrically-shaped battery located in the battery receptacle, where the battery partially protrudes above the inside surface; and a microphone, where a surface of the microphone is nearly tangential to the cylindrical surface of the battery and the surface of the microphone tangential to the battery surface is oriented at a non-right angle with respect to the plane of the faceplate.

* * * * *